US011110499B2

(12) United States Patent
Bierhalter

(10) Patent No.: US 11,110,499 B2
(45) Date of Patent: Sep. 7, 2021

(54) CIRCULAR ROLLING MILL WITH SHAPING ROLLERS AND METHOD FOR CONTROLLING THE POSITION OF A ROLLER OF SUCH A ROLLING MILL

(71) Applicant: FORGE PAT GMBH, Reinach (CH)

(72) Inventor: Peter Bierhalter, Rheinfelden (CH)

(73) Assignee: FORGE PAT GMBH, Reinach (CH)

( * ) Notice: Subject to any disclaimer, the term of this patent is extended or adjusted under 35 U.S.C. 154(b) by 0 days.

(21) Appl. No.: 16/338,268

(22) PCT Filed: Sep. 29, 2017

(86) PCT No.: PCT/EP2017/074736
§ 371 (c)(1),
(2) Date: Mar. 29, 2019

(87) PCT Pub. No.: WO2018/060399
PCT Pub. Date: Apr. 5, 2018

(65) Prior Publication Data

US 2019/0232348 A1 Aug. 1, 2019

(30) Foreign Application Priority Data

Sep. 30, 2016 (EP) ..... 16306289

(51) Int. Cl.
*B21B 31/32* (2006.01)
*B21H 1/06* (2006.01)
(Continued)

(52) U.S. Cl.
CPC ..... *B21B 31/32* (2013.01); *B21B 13/10* (2013.01); *B21B 37/52* (2013.01); *B21H 1/06* (2013.01)

(58) Field of Classification Search
CPC ..... B21H 1/06; B21B 31/00; B21B 31/02; B21B 31/16; B21B 31/32; B21B 31/10; B21B 37/52
See application file for complete search history.

(56) References Cited

U.S. PATENT DOCUMENTS 3,186,202 A * 6/1965 Ulrych ..... B21H 1/06 72/9.5
3,698,218 A * 10/1972 Wieting ..... B21H 1/06 72/11.2
(Continued)

FOREIGN PATENT DOCUMENTS

CN 102036767 A 4/2011
CN 105522082 A 4/2016
(Continued)

OTHER PUBLICATIONS

English translate (JPH07185711A), retrieved date Oct. 28, 2020.*
(Continued)

*Primary Examiner* — Adam J Eiseman
*Assistant Examiner* — Mohammed S. Alawadi
(74) *Attorney, Agent, or Firm* — Troutman Pepper Hamilton Sanders LLP

(57) ABSTRACT

This circular rolling mill has a fixed main frame, a pair of cylindrical rollers, internal and external, to shape internal and external radial faces of an annular part and supported by a first secondary frame mounted on the main frame, as well as a pair of conical rollers, upper and lower, to shape opposite front faces of the part and supported by a second secondary frame mounted on the main frame. At least one rack and pinion assembly moves a roller in translation relative to one of the secondary frames. At least one electric geared motor drives the pinion of the rack and pinion assembly. The electric geared motor is fixedly mounted relative to one of the auxiliary frames. A fluid discharge
(Continued)

mechanism is interposed in a kinematic chain for transmitting force between the rack and the roller moved by this rack. The fluid discharge mechanism has at least one variable volume chamber supplied with pressurized fluid and the volume of which varies as a function of the relative position of the roller and of the rack.

18 Claims, 10 Drawing Sheets

(51) Int. Cl.
*B21B 13/10* (2006.01)
*B21B 37/52* (2006.01)

(56) References Cited

U.S. PATENT DOCUMENTS 3,824,820 A * 7/1974 Jeuken ..... B21H 1/06 72/12.1
4,326,397 A * 4/1982 Strugala ..... B21H 1/06 72/106
4,339,937 A * 7/1982 Strugala ..... B21H 1/06 72/105
2004/0250586 A1* 12/2004 Balagna ..... F16C 33/64 72/91
2011/0138871 A1* 6/2011 Vinzant ..... B21H 1/06 72/252.5
2015/0290689 A1* 10/2015 Bolik ..... B21J 9/10 72/249
2015/0290700 A1* 10/2015 Bolik ..... B21H 1/06 72/12.8
2016/0288196 A1* 10/2016 Iwasa ..... B21H 1/06

FOREIGN PATENT DOCUMENTS

CN 205436945 U 8/2016
DE 20 2010 014 708 U1 2/2011
JP 54-102275 A 8/1979
JP 61-35323 Y2 10/1986
JP 62-101333 A 5/1987
JP 7-185711 A 7/1995
JP H07185711 A * 7/1995
WO 2009/125102 A1 10/2009
WO 2016020869 A1 2/2016

OTHER PUBLICATIONS

What Are Hydraulic Cylinders, retrieved date Oct. 28, 2020.*
Hydraulic cylinder, retrieved date Oct. 28, 2020.*
Written Opinion and International Search Report dated Jan. 24, 2018 issued in corresponding International Patent Application No. PCT/EP2017/074736.

* cited by examiner

CIRCULAR ROLLING MILL WITH SHAPING ROLLERS AND METHOD FOR CONTROLLING THE POSITION OF A ROLLER OF SUCH A ROLLING MILL

CROSS REFERENCE TO RELATED APPLICATIONS

This is a U.S. national phase application under 35 U.S.C. § 371 of International Patent Application No. PCT/EP2017/074736, filed Sep. 29, 2017, and claims benefit of priority to European Patent Application No. 16306289.6, filed Sep. 30, 2016. The entire contents of these applications are hereby incorporated by reference.

FIELD OF THE INVENTION

The invention relates to a circular rolling mill that comprises two pairs of rollers intended to shape radial faces and front faces of an annular part.

BACKGROUND

In this type of rolling mill, it is known that the rollers must be moved, during operation of the rolling mill, to adapt their position to the dimensions of the part being shaped. Traditionally, hydraulic jacks can be used to move the rollers. This requires having a large quantity of pressurized oil, to the point that a relatively bulky hydraulic unit must be provided near the rolling mill.

To offset this problem, it is known from WO-A-2009/125102 to use, in order to move the rollers of a circular rolling mill, pinion-rack assemblies whereof the pinion is rotated by the output shaft of an electric geared motor. To limit the risks of breaking in case of irregularity of the surface with which a roller interacts, it is provided to mount the electric geared motor on a support, which in turn is articulated around the rotation axis of the pinion, relative to a frame of the rolling mill. Furthermore, damping means are provided to damp the pivoting of the support. The mounting of the electric geared motor on an articulated support makes the rolling mill more complex, which increases its cost and causes additional maintenance operations.

The invention more particularly aims to resolve these drawbacks by proposing a circular rolling mill in which the rollers can be moved by an electric geared motor, without it being necessary to install said electric geared motor on a pivoting support.

To that end, the invention relates to a circular rolling mill comprising a fixed main frame, a pair of cylindrical rollers, respectively internal and external, intended to shape internal and external radial faces of an annular part and supported by a first auxiliary frame mounted on the main frame, and a pair of conical rollers, respectively upper and lower, intended to shape opposite front faces of the part and supported by a second auxiliary frame mounted on the main frame. At least one rack and pinion assembly is provided to move a roller in translation relative to the auxiliary frame that supports it and at least one electric geared motor is provided to drive the pinion of this pinion and rack assembly. According to the invention, the electric geared motor is fixedly mounted relative to one of the auxiliary frames, while a fluid discharge mechanism is interposed in a kinematic chain for transmitting force between the rack and the roller moved by this rack. Furthermore, the fluid discharge mechanism comprises at least one variable volume chamber supplied with pressurized fluid and the volume of which varies as a function of the relative position of the roller and of the rack.

Owing to the invention, the fact that the electric geared motor is mounted fixedly relative to the main or secondary frame simplifies the general structure of the rolling mill. During normal operation, the mounting mode of the motor makes it possible to form a fixed point, which allows precise control of the pinion and rack assembly, therefore of the position of the associated roller. In case of irregularity on the surface shaped by the roller, the fluid discharge mechanism makes it possible to absorb the temporary overload transmitted to the kinematic chain, without the rack being moved, therefore without risk of damaging the electric geared motor.

According to advantageous but optional aspects of the invention, such a rolling mill may incorporate one or more of the following features, considered in any technically allowable combination:

- The kinematic chain comprises a transmission bar for transmitting a movement to the roller for moving the rack along a longitudinal axis of the bar and the variable volume chamber is defined between
  on the one hand, the bar or a part secured to the bar; and
  on the other hand, the rack or a part rigidly fastened to the rack.
- The variable volume chamber is defined inside the bar.
- Alternatively, the variable volume chamber is defined, along the longitudinal axis of the bar, between the rack and the bar.
- The rolling mill comprises a system for supplying the variable volume chamber with fluid under a pressure greater than or equal to 100 bars, preferably greater than or equal to 200 bars, still more preferably of about 250 bars.
- The kinematic chain is configured so that, in case of irregularity protruding on the surface of an annular part shaped by the roller, the movement caused by this irregularity on the bar tends to drive the pressurized fluid from the variable volume chamber, by reducing its volume.
- The fluid discharge mechanism comprises a piston secured to the rack and one face of which defines the variable volume chamber.
- The piston is mounted sliding inside the bar, along the longitudinal axis of the bar.
- The piston is secured to the rack via a rack support and a connecting rod between the rack support and the piston, the rack support and the connecting rod also being mounted sliding inside the bar, along the longitudinal axis of the bar.
- The rolling mill comprises members for guiding the translation, along the longitudinal axis of the bar, of the rack support and/or the connecting bar, inside the bar, in particular of guiding skids.
- The variable volume chamber is defined between the face of the piston and a cover that closes off an internal volume of the bar, opposite the roller.
- Alternatively, part of the bar is received sealably in an internal cavity defined by the rack and the variable volume chamber is formed by the portion of this cavity not occupied by the bar.
- The variable volume chamber is connected to the pressurized fluid supply system by a pipe that passes through the rack.
- Each roller translatable relative to a secondary frame is moved by a pinion and rack assembly driven by an electric geared motor mounted fixedly relative to said frame, with insertion of a fluid discharge mechanism in the kinematic force transmission chain between each rack and the roller driven by said rack.

According to another aspect, the invention relates to a method for controlling the position of at least one roller for shaping a face of a part to be shaped within a circular rolling mill that comprises a fixed main frame, a pair of rollers, respectively internal and external, intended to shape internal and external radial faces of this part and supported by a first auxiliary frame mounted on the main frame, as well as a pair of conical rollers, respectively upper and lower, intended to shape opposite front faces of the part and supported by a second auxiliary frame mounted on the main frame, this roller also comprising at least one pinion and rack assembly for moving a roller relative to the auxiliary frame that supports it and at least one electric geared motor to drive the pinion of this pinion and rack assembly. According to the invention, this method comprises the following steps:

a) supplying pressurized fluid to a variable volume chamber integrated into a discharge mechanism interposed in a kinematic force transmission chain between the rack and the roller moved by this rack, to stiffen this kinematic chain during normal operation of the rolling mill, and b) discharging at least part of the pressurized fluid from the variable volume chamber, owing to a dimensional variation of the kinematic chain, in case of irregularity on the face of the part to be shaped that is shaped by the roller.

BRIEF DESCRIPTION OF THE DRAWINGS

The invention will be better understood, and other advantages thereof will appear more clearly, in light of the following description of one embodiment of a rolling mill and a control method according to its principle, provided solely as an example and done in reference to the appended drawings, in which.

DETAILED DESCRIPTION

Figure 1:
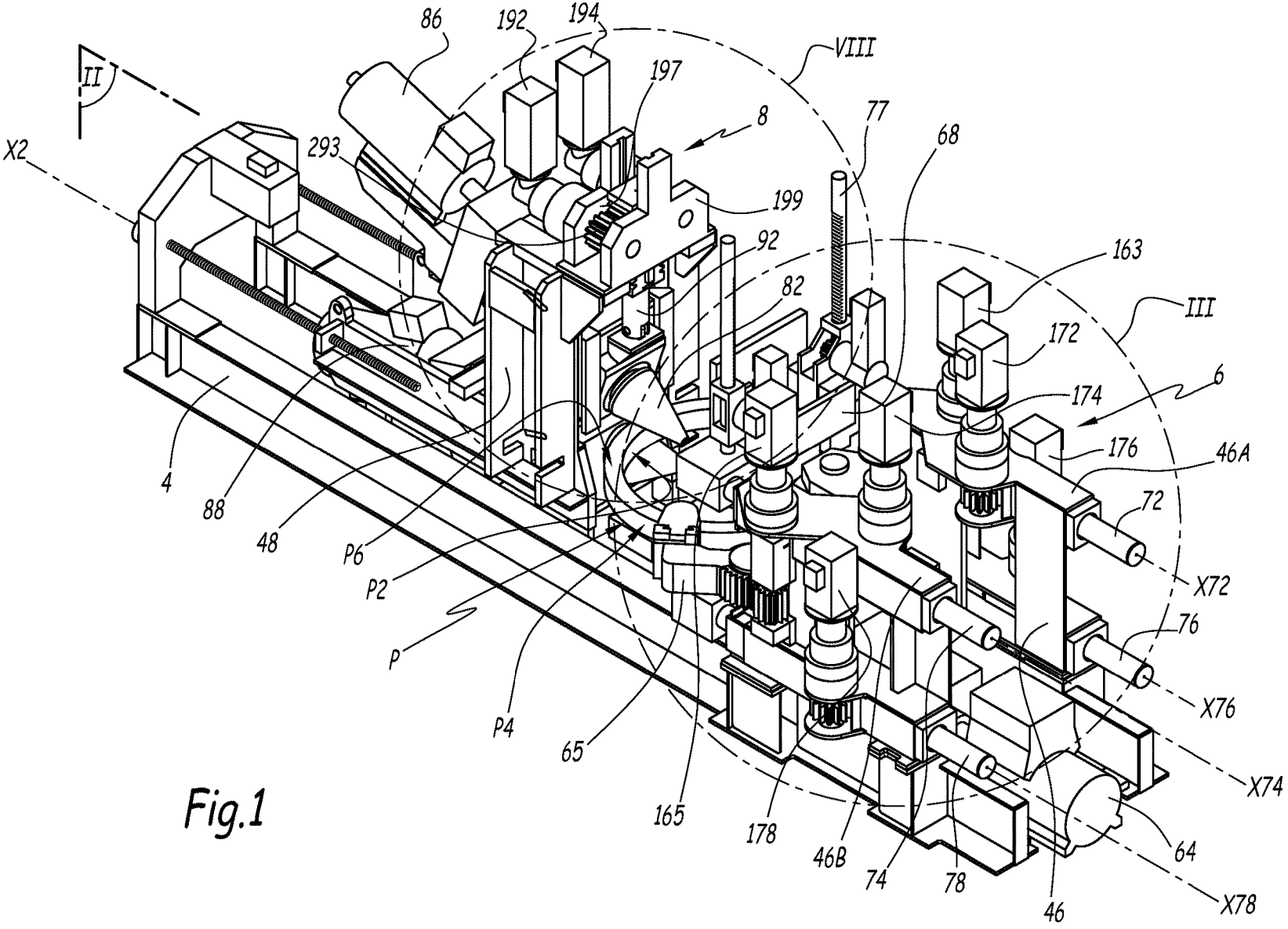
FIG. 1 is a perspective view of a rolling mill according to the invention.

The rolling mill 2 shown in FIGS. 1 to 10 comprises a fixed main frame 4 that defines a longitudinal axis X2 of the rolling mill 2. The frame 2 supports a radial cage 6 that is mounted fixedly on said frame, as well as an axial cage 8 that is movable relative to the frame 4, along the axis X2.

A first auxiliary frame 46 is mounted fixedly on the main frame 4 and constitutes the armature of the radial cage 6. A second auxiliary frame 48 is mounted on the main frame 4 while being movable along the axis X2 relative to this main frame. The auxiliary frame 48 constitutes the armature of the axial cage 8.

Reference P denotes a part in the process of being shaped in the rolling mill 2. This part is centered on an axis XP that is vertical and perpendicular to the axis X2. References P2 and P4 respectively denote internal and external radial surfaces of the part. Likewise, references P6 and P8 denote upper and lower front surfaces of said part, when it is in place in the rolling mill 2.

The frame 46 of the radial cage 6 bears a cylindrical main roller 62 mounted rotating around a vertical axis Z62 and rotated by a main electric motor 64. The main roller 62 is mounted in the radial cage 6 to bear against the external radial surface P4 of the part P.

The frame 46 of the radial cage 6 also supports a cylindrical secondary roller or mandrel 66 mounted rotating around a vertical axis Z66 parallel to the axis Z62. The secondary roller 66 is supported by a cross-piece 68 that is movable, parallel to the axis X2, relative to the secondary frame 46 of the radial cage 6. To that end, the cross-piece 68 is secured to two bars 72 and 74 that each extend in a direction parallel to the axis X2.

The rollers 62 and 66 are solid and have a circular section.

Furthermore, a plate 70 is mounted below the cross-piece 68 and provided with a housing 70A for receiving the lower part of the secondary roller 66. This plate 70 is also movable relative to the auxiliary frame 46 while being supported by two bars 76 and 78.

References X78, X74, X76 and X78 respectively denote the longitudinal axes of the bars 74 to 78 that are parallel to the axis X2.

The radial cage 6 also comprises two centering arms of the part P, only one of these centering arms being visible in FIG. 1 with reference 65.

A lifting system with racks 77 and 79 makes it possible to lift the cross-piece 68 during the placement of the part P in the rolling mill 2, then to lower it to insert the lower portion of the secondary roller 66 into the housing 70A of the plate 70.

Several electric geared motors are provided in the radial cage 6, namely:

- two electric geared motors 172 and 174 for driving the bars 72 and 74, along their respective longitudinal axes X72 and X74,
- two electric geared motors 176 and 178 for driving the bars 76 and 78, along their respective longitudinal axes X76 and X78,
- two electric geared motors 163 and 165 for rotating the centering arms 65 and equivalent means, around vertical axes Z63 and Z65.

The geared motor 172 comprises an electric motor 172A and a reduction gear 172B. The other geared motors have the same structure, each with an electric motor associated with a reduction gear.

Figure 3:
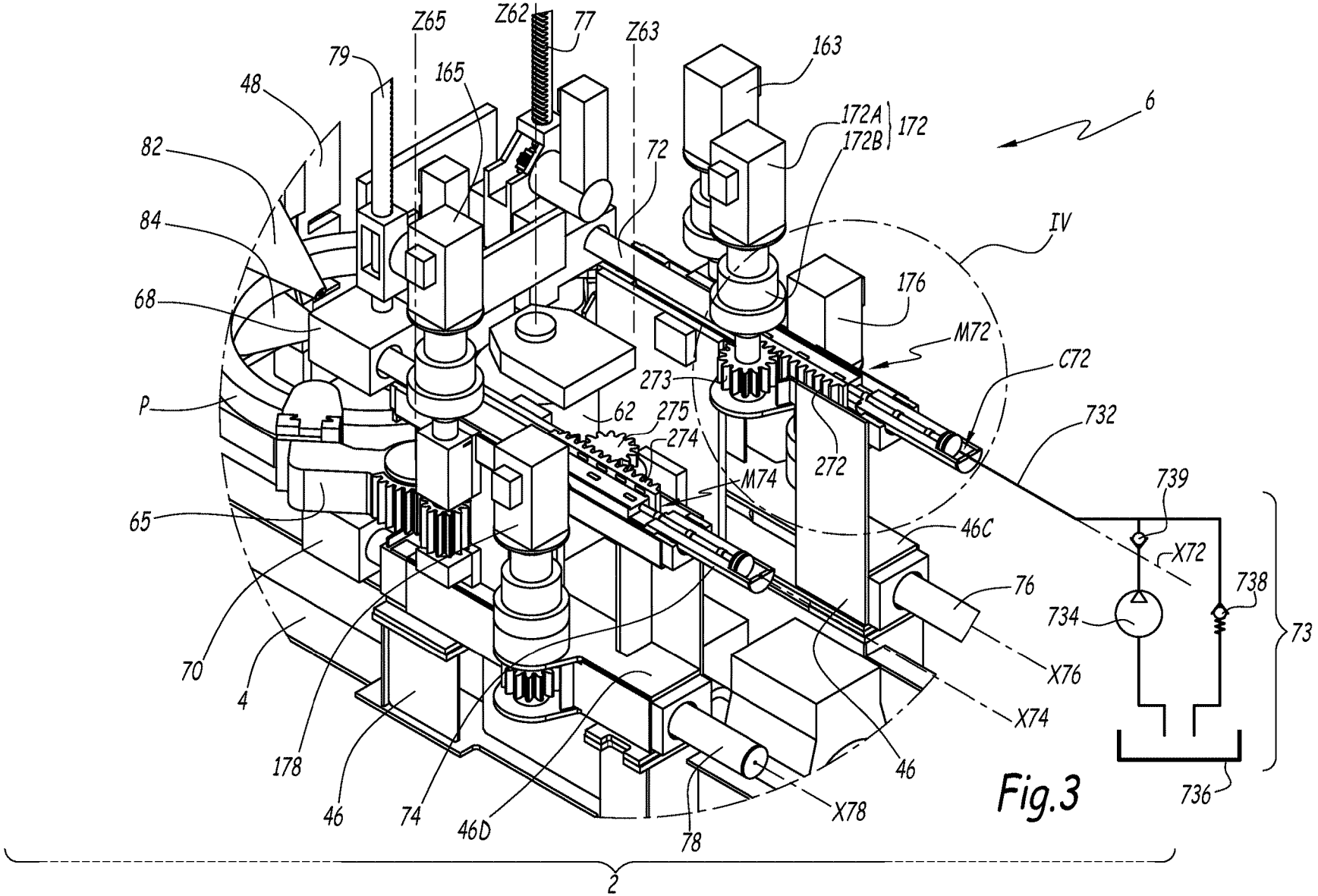
FIG. 3 is an enlarged view of detail III in FIG. 1 when the rolling mill is in a first normal operating configuration; for the clarity of the drawing, some support plates and a geared motor have been omitted from this FIG. 3, and some bars are shown in partial tear-away.

In FIG. 3, the geared motor 174 is omitted, to make it possible to view the bar 74 and the associated pinion 273.

The bars 72 to 78 make it possible to transmit a displacement movement to the roller 66, parallel to the axis X2 and each of the axes X72 to X78, generated by the geared motors 172 to 178.

Each of the geared motors 172 to 178 is mounted fixedly relative to the auxiliary frame 46 of the radial cage 6. For example, the geared motor 172 is supported rigidly by a plate 46A belonging to the auxiliary frame 46. Likewise, the geared motor 174 is supported rigidly by a plate 46B belonging to the auxiliary frame 46. The geared motors 176 and 178 are supported by plates 46C and 46D of the auxiliary frame 46. For the clarity of the drawing, the plates 46A and 46B are omitted in FIGS. 3 to 7. One can see in FIG. 1 that they also support the geared motors 163 and 165. However, this is not mandatory.

During normal operation of the rolling mill 2, the part P is compressed radially between the rollers 62 and 66, which are rotated, around axes Z62 and Z66, directly by the motor 64, for the roller 62, and indirectly through the part P, for the roller 66.

A pinion and rack assembly is used to transmit a movement from each geared motor 172 to 178 to the secondary roller or mandrel 66, in order to control the position of this roller in translation along the axis X2.

Thus, a pinion 273 is mounted on the output shaft of the reduction gear 172B. This pinion 273 cooperates with a rack 272 mounted on the bar 72.

The mounting of the rack 272 on the bar 72 is rigid in the normal usage configuration of the rolling mill 2. This mounting, however, comprises a degree of freedom, which can be implemented in case of irregularity on the surface P2 of the part P, in a direction where a protruding relief present on this surface P2 tends to move the secondary roller or mandrel 66 toward the axis XP. Likewise, a degree of freedom is implemented in the mounting of the rack 272 on the bar 72 when an irregularity results from a protruding relief on the surface P4 that tends to push back the part P and the secondary roller 66 toward the axis XP, by reaction against the main roller 62, the axis Z62 of which is fixed relative to the auxiliary frame 46.

To that end, and as visible in FIGS. 3 to 7, a fluid discharge mechanism M72 is integrated into kinematic chain KC between the rack 272 and the roller 66, specifically into the bar 72 and makes it possible to allow a relative movement, along the axis X72, between the roller 62 and the rack 272, more specifically between the rack 272 and the bar 72 that is rigidly fastened to the roller 66, along the axis X2, via the crosspiece 68.

In FIG. 3, the lids 46A and 46B are omitted and the bars 72 and 74 are shown with half tear-away in a horizontal plane. This makes it possible to view the mechanism M72 and the equivalent mechanism M74 associated with the bar 74.

The mechanism M72 comprises a rack support 720 rigidly connected to the rack 272, for example by screws, not shown. This support 720 is received in a housing 722 arranged inside the bar 72, with an axial length L722, measured parallel to the axis X72, which is greater than the axial length L720 of the support 720, also measured parallel to said axis. Thus, the support 720 can slide inside the housing 722, parallel to the axis X72. The mechanism M72 also comprises a piston 724 that is positioned in an end housing 726 arranged at the end 72A of the bar 72 that is opposite the cross-piece 68, therefore the secondary roller 66. The end housing 726 is closed off by a cover 728 rigidly fastened to the bar 72.

The mechanism M72 also comprises a connecting rod 723 between the support 720 and the piston 724. The rod 723, which for example is in simple bearing against the support 720 and the piston 724, is positioned in a central and longitudinal channel 725 of the rod 72 that connects the housings 722 and 726 to one another. The compression of the rod 723 between the support 720 and the piston 724 makes it possible to create a rigid connection between the parts 720, 723 and 724 in translation parallel to the axis X72 when the support moves the piston to the right in FIG. 5 or when the piston moves the support to the left in this figure.

The parts 72, 272, 720, 723 and 724 are made from metal, for example steel. Guide skids 727, for example made from bronze, are provided on the support 720 to guide it inside the housing 722 and facilitate its sliding. Likewise, guide rings 729, for example made from copper, are provided around the rod 723, inside the channel 725. Alternatively, only the skids 727 or 729 are provided.

The piston 724 is equipped with sealing gaskets 724A that allow it to isolate part of the end housing 726, situated between its face 724 turned toward the cover 728 and this cover, of the channel 725. Thus, a variable volume chamber C72 is defined in the end housing 726, between the face 724B of the piston 724 and the cover 728.

This variable volume chamber C72 is supplied with pressurized oil through an orifice 728A of the cover 728 and a pipe 732 that belongs to a supply system 73 supplying the chamber C72 with pressurized oil, with a pressure greater than 100 bars. In practice, the pressure delivered by the system 73 is chosen to be greater than 200 bars, preferably around 250 bars. The system 73 may comprise, as shown schematically in FIGS. 3, 5 and 7, a pump 734 that delivers oil at the input pressure, by drawing it from a tub 736, and a tared nonreturn valve 738 connects the pipe 732 to the tub 736. Another nonreturn valve 739, mounted in the opposite direction from the nonreturn valve 738, at the outlet of the pump 732, prevents the oil from circulating through the pump, in the opposite direction, i.e., from its outlet toward its inlet.

Thus, the system 73 makes it possible to deliver, inside the chamber C72, oil at a pressure equal to the output pressure of the pump 734. The valve 738 is preferably tared such that, if the pressure in the chamber C72 and in the pipe 732 exceeds the output pressure of the pump 734, the oil present in the pipe 732 is returned to the tub 736, through said valve.

The system 73 is a system known in the hydraulic field. In light of the volume of oil that it contains, around one or two liters, it is much easier to implement and much less expensive than the units traditionally used in rolling mills to supply jacks provided to move the shaping rollers.

The discharge mechanism M72 comprises the bar 72 as well as the parts and volumes 720 to 729.

By default, the pressure of the oil present in the chamber C72, on the order of 250 bars, is sufficient to stiffen the kinematic link between the rack 272 and the bar 72, therefore between the rack 272 and the secondary roller 66, during normal operation of the rolling mill 2.

The bars 74, 76 and 78 are also connected to the motors 174, 176 and 178 by kinematic chains KC that each include a fluid discharge mechanism of the type of the mechanism M72, the mechanism M74 used for the bar 74 being visible in FIG. 3, while the corresponding mechanisms M76 and M78 used for the bars 76 and 78 are hidden by the plates 46C and 46D. The discharge mechanism M74 is inserted between, on the one hand, an assembly comprising a pinion 275 and a rack 274, and, on the other hand, the cross-piece 68, via the bar 74. The mechanisms M76 and M78 are inserted between, on the one hand, the pinion and rack assemblies mounted at the base of the geared motors 176 and 178 and, on the other hand, the plate 70.

Figure 4:
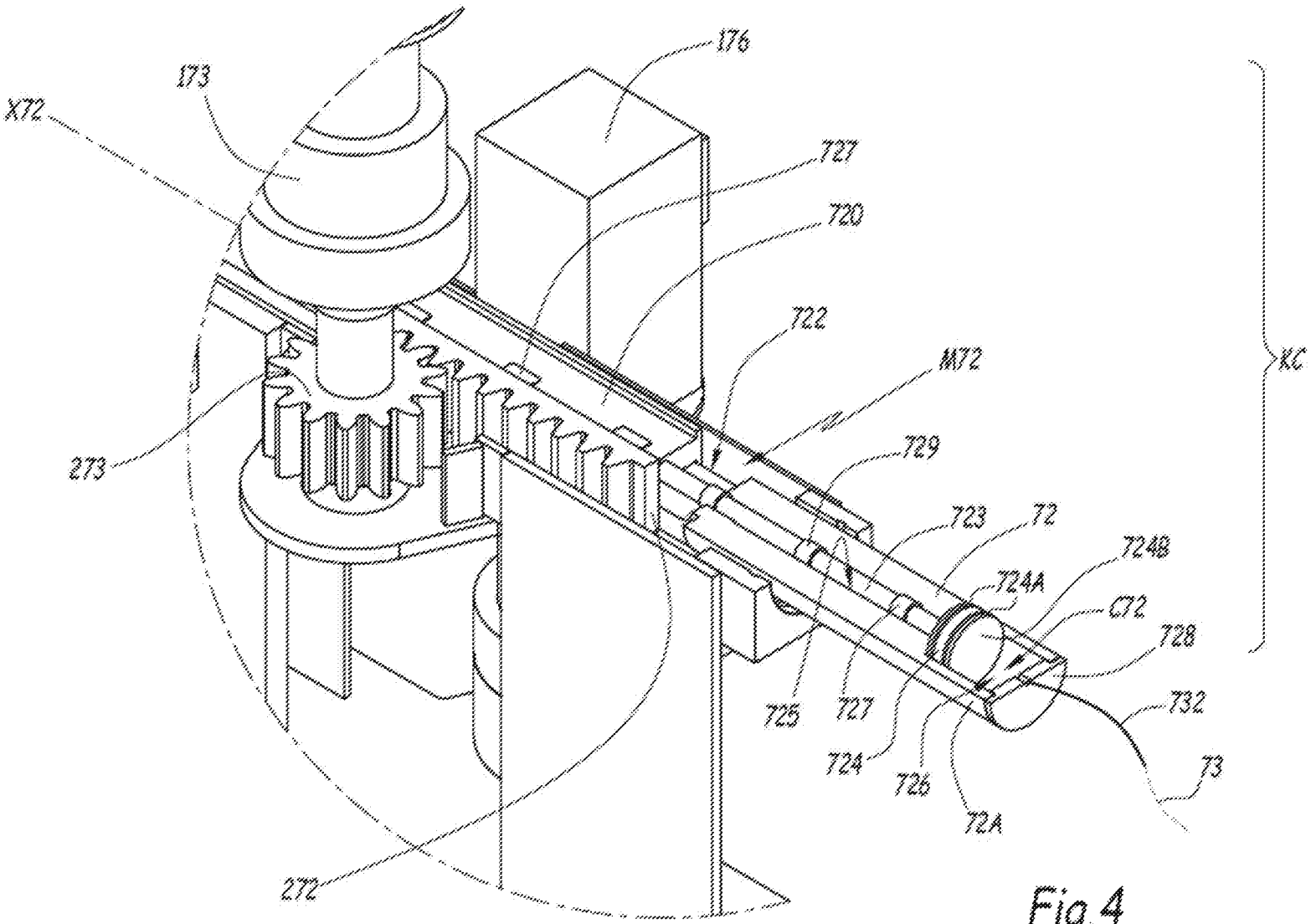
FIG. 4 is an enlarged view of detail IV from FIG. 3.
Figure 5:
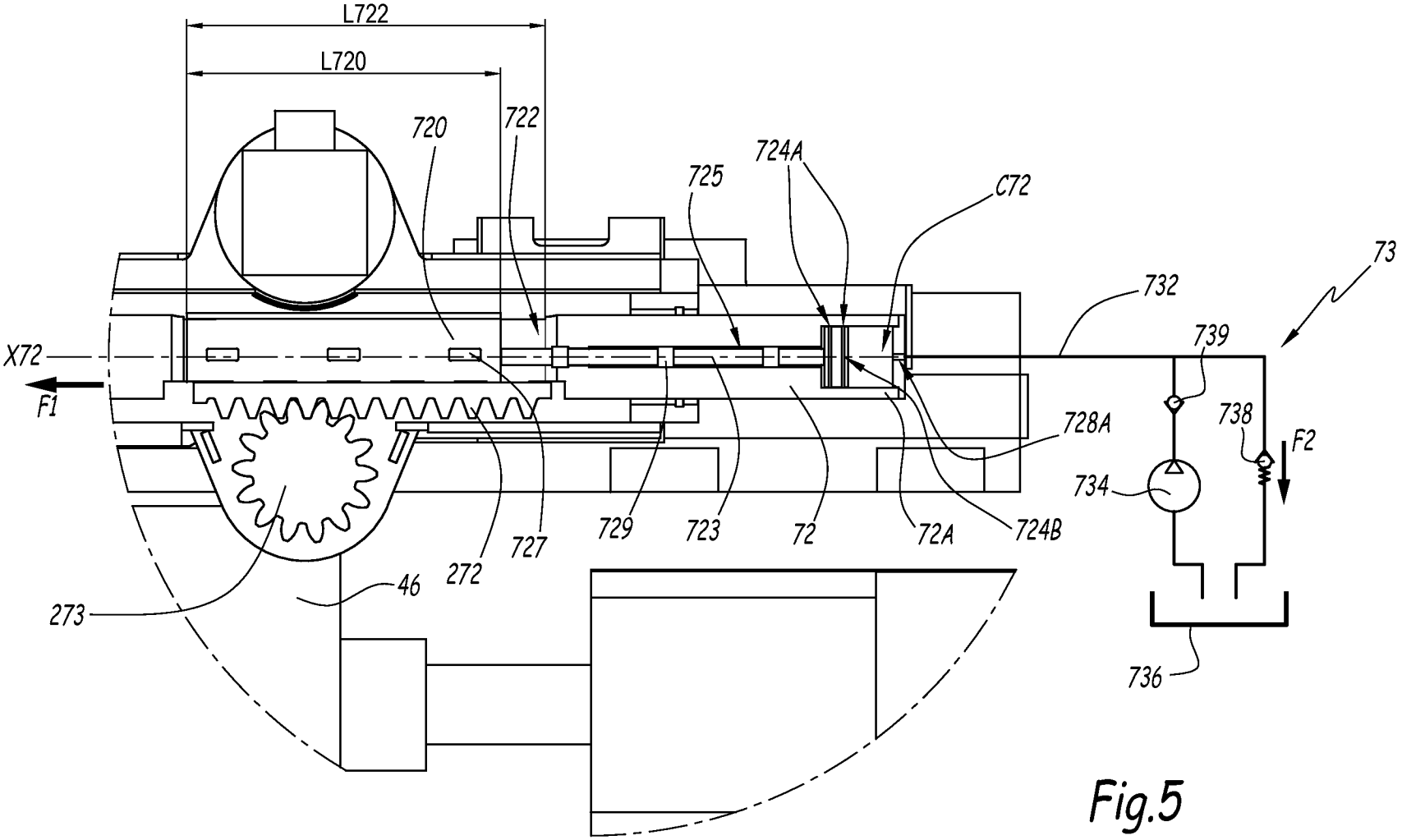
FIG. 5 is a top view corresponding to detail IV.
Figure 6:
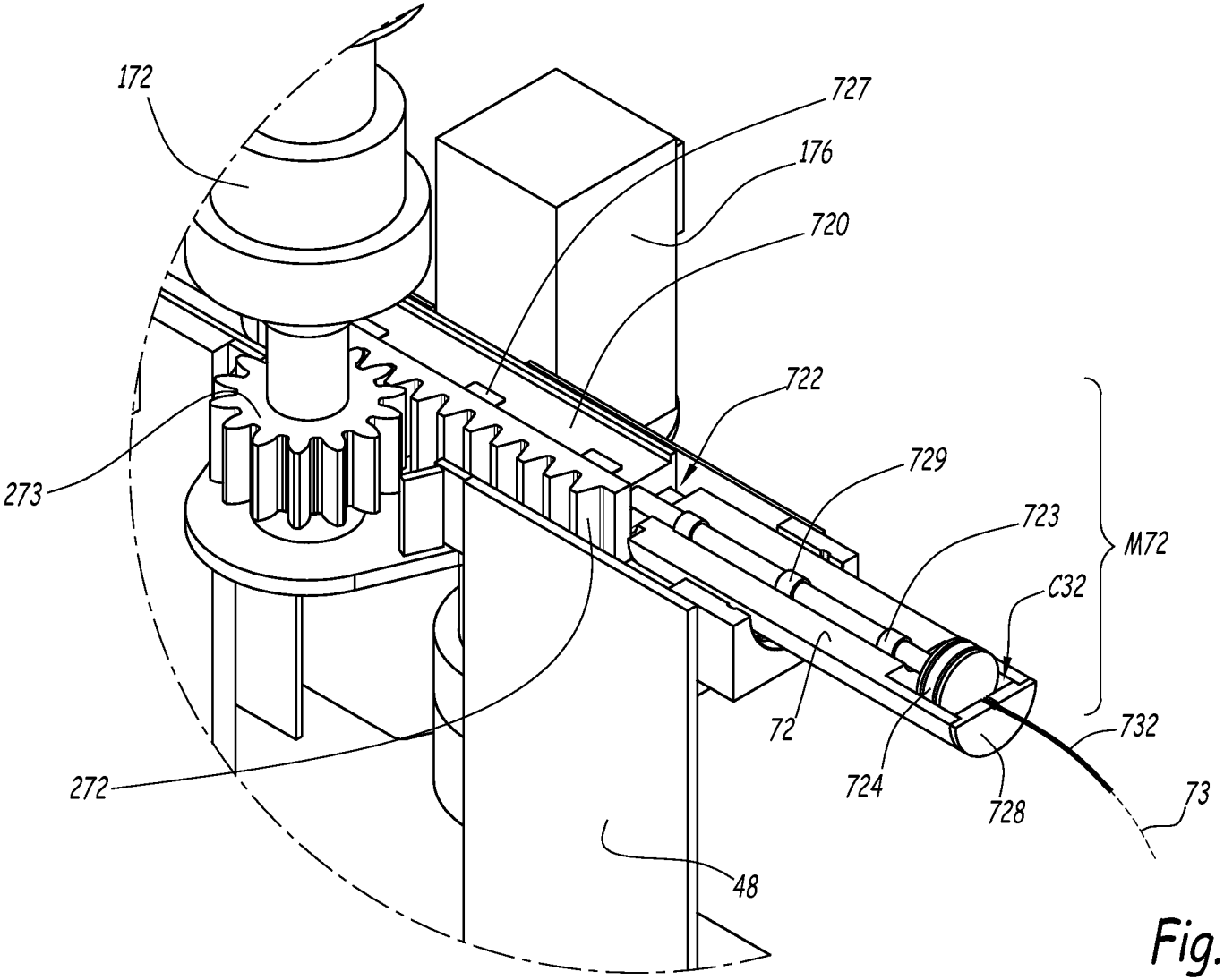
FIG. 6 is a view similar to FIG. 4 when the rolling mill is in a second operating configuration, in case of irregularity on a radial surface of a part during shaping within the rolling mill.

By default, the rolling mill is in the configuration of FIGS. 3 to 5.

In FIG. 3, only one supply system 73 is shown. In practice, it is possible to provide such a system to supply the discharge mechanism M72, M74 or equivalent associated with each bar 74 to 78, or a system shared by some or all of these mechanisms.

Figure 2:
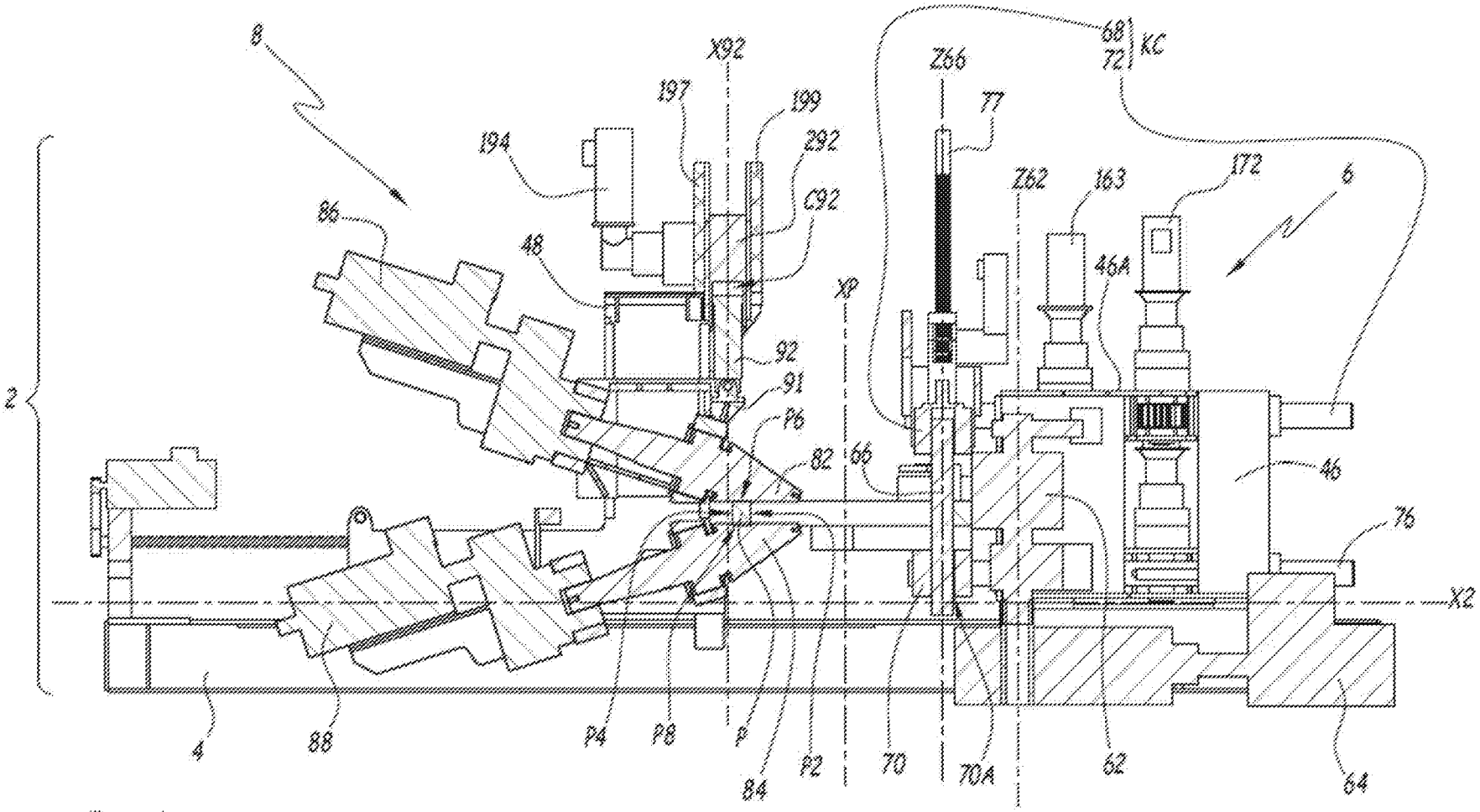
FIG. 2 is a longitudinal sectional block diagram of the rolling mill, along plane II from FIG. 1.

In case of relief protruding on one of the radial surfaces P2 or P4 of the part P, the secondary roller 66 is moved temporarily toward the axis XP, which drives the movement of the cross-piece 68 and the plate 70 in the same direction, toward the left in FIG. 2.

This movement is transmitted to the bars 72 to 78, which are rigidly connected to the parts 68 and 70.

Hereinafter, we consider what happens at the bar 72, with the understanding that the operation is the same at the bars 74 to 78.

Figure 7:
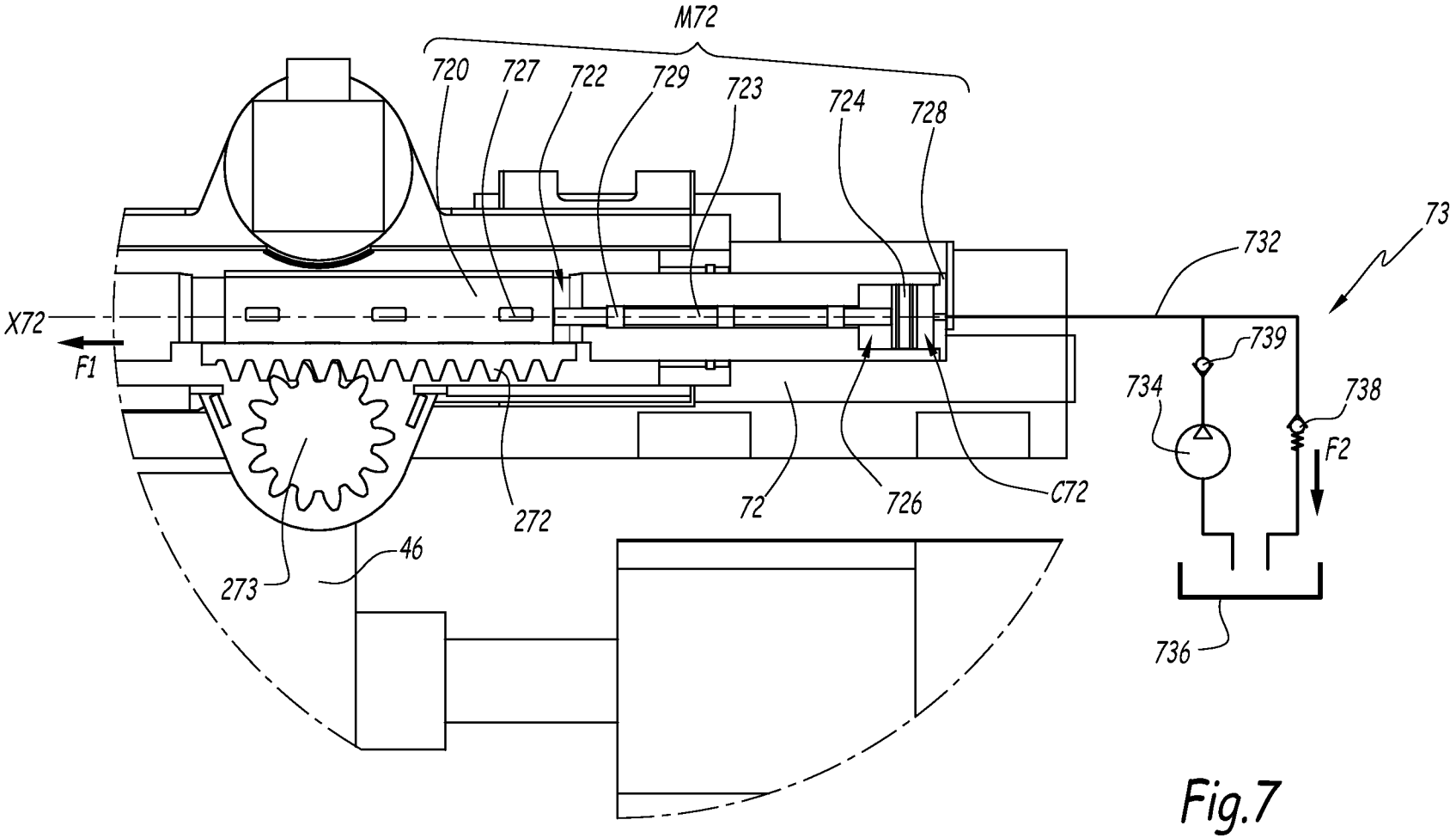
FIG. 7 is a top view corresponding to the detail from FIG. 6.

Under the effect of the temporary movement of the cross-piece 68, the bar 72 is moved abruptly toward the axial cage 8, in the direction of arrow F1 in FIG. 7. This movement should be prevented from being transmitted to the geared motor 172, to limit the risks of breaking and premature wear of this equipment. This movement of the bar 72 is transmitted to the cover 728, which results in increasing the oil pressure inside the variable volume chamber C72. This pressure increase is reflected by the discharge of the oil from the chamber C72 toward the supply system 73, through the orifice 728A. In this case, the pressure of the oil leaving the chamber C72 is greater than the output pressure of the pump 734 and the oil, blocked by the nonreturn valve 739, flows in return toward the tub 736, through the valve 738, as shown by arrow F2 in FIG. 7.

In other words, due to the movement of the bar 72 in the direction of arrow F1, the piston 724, which is rigidly fixed to the rack 272 through the rod 723 and the support 720, moves inside the housing 726 in a direction reducing the volume of the chamber C72. This makes it possible, in the coordinate system of the secondary frame 46, for the piston 724, the rod 723, the support 720 and the rack 272 to remain fixed, while the bar 72 moves in the direction of arrow F1. In other words, the discharge mechanism M72 allows a relative movement of the rack 272 and the bar 72, which prevents the transmission to the pinion 273 and, through it, the geared motor 172, of a violent acceleration that could damage the motor 172A and/or the reduction gear 172B. The discharge mechanism M72 therefore constitutes a mechanism for protecting the electric motor 172A, the reduction gear 172B and the pinion and rack assembly 272-273 against violent accelerations that could result from surface irregularities of the part during shaping in the rolling mill 2.

Comparing FIGS. 5 and 7 makes it possible to note that, although the bar 71 has moved to the left, in the direction of arrow F1, the rack 272 and the pinion 273 have kept their positions, due to the reduction in the volume of the chamber C72.

The axial cage 8 comprises two conical rollers 82 and 84 intended respectively to act on the upper front surface P6 and the lower front surface P8 of the part.

The conical rollers 82 and 84 are each rotated by an electric motor 86 or 88 supported by the auxiliary frame 48.

The roller 82 is supported by a platen 90 that is vertically movable, along an axis Z90 parallel to the axes Z62 and Z66, relative to the secondary frame 48.

To that end, the platen 90 is rigidly fastened to a shoe 91, which in turn is hitched to the lower end 92A of a bar or column 92. Like the bars 72 to 78, the bar 92 makes it possible to transmit, to the roller 82, a translational movement along its longitudinal axis X92 combined with the axis Z90.

The movement of the bar 92 along the axis Z90 is controlled by a double-toothed rack 292, in turn controlled by two geared motors 192 to 194 mounted fixed on the frame 48. Pinions 293 and 295 are respectively mounted on the output shafts of the geared motors 192 and 194 and simultaneously mesh with the two provided toothings, on either side of the axis Z90, on the rack 292.

Figure 8:
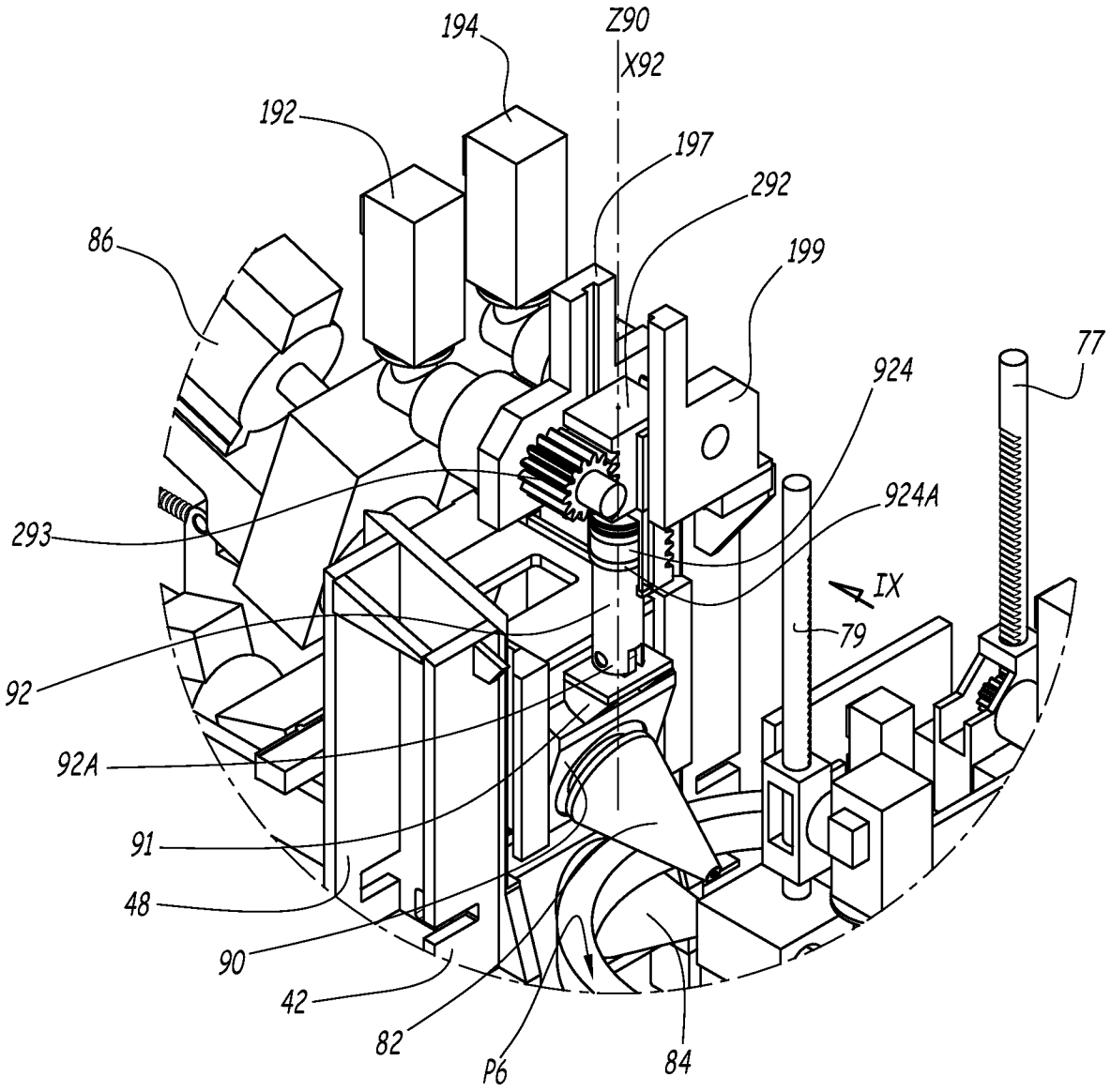
FIG. 8 is an enlarged view of detail VIII from FIG. 1 when a guide plate is partially omitted for the clarity of the drawing.
Figure 9:
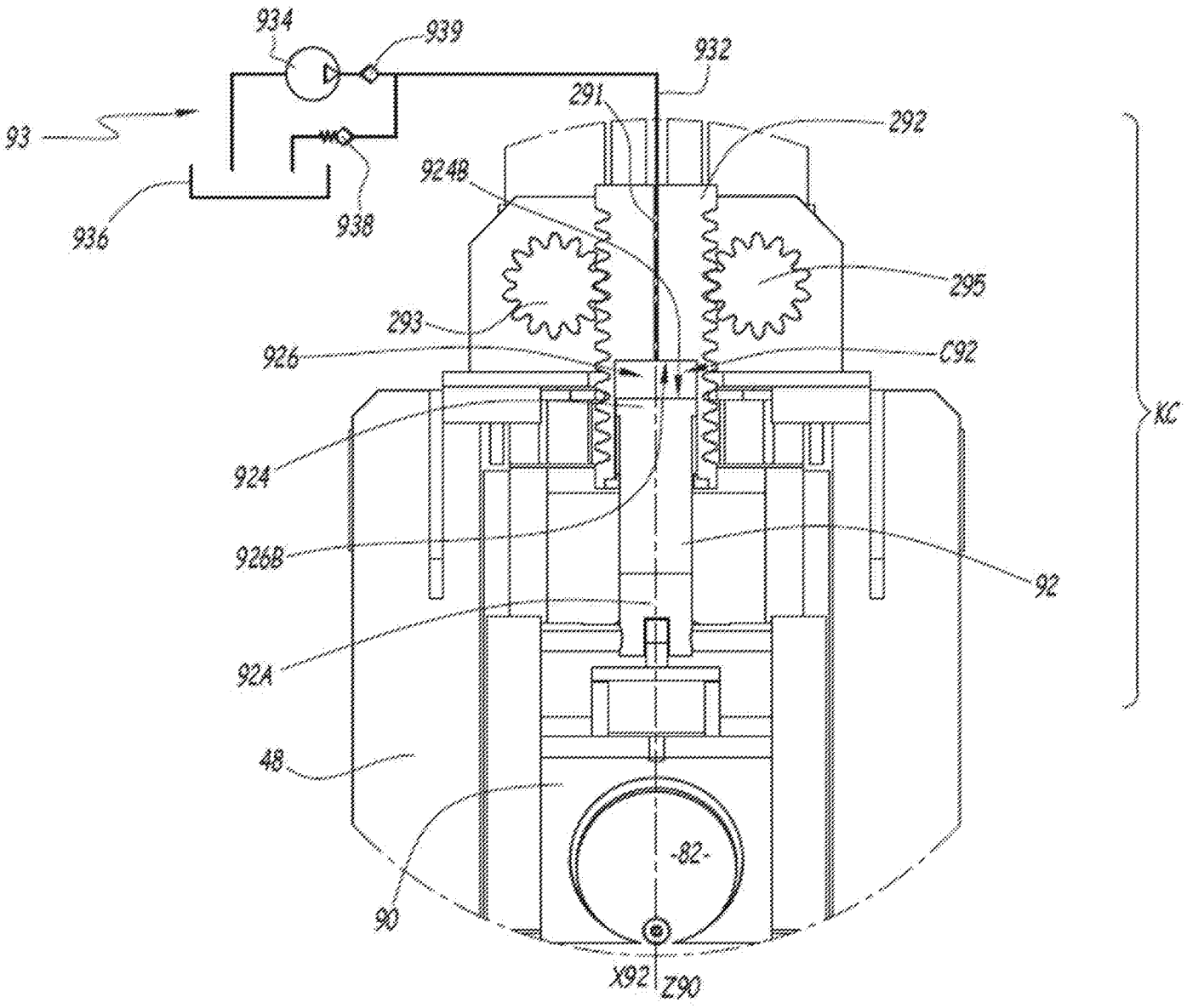
FIG. 9 is an elevation view in the direction of arrow IX from FIG. 8 when the rolling mill is in a first normal operating configuration; for the clarity of the drawing, the guide plate is completely omitted.
Figure 10:
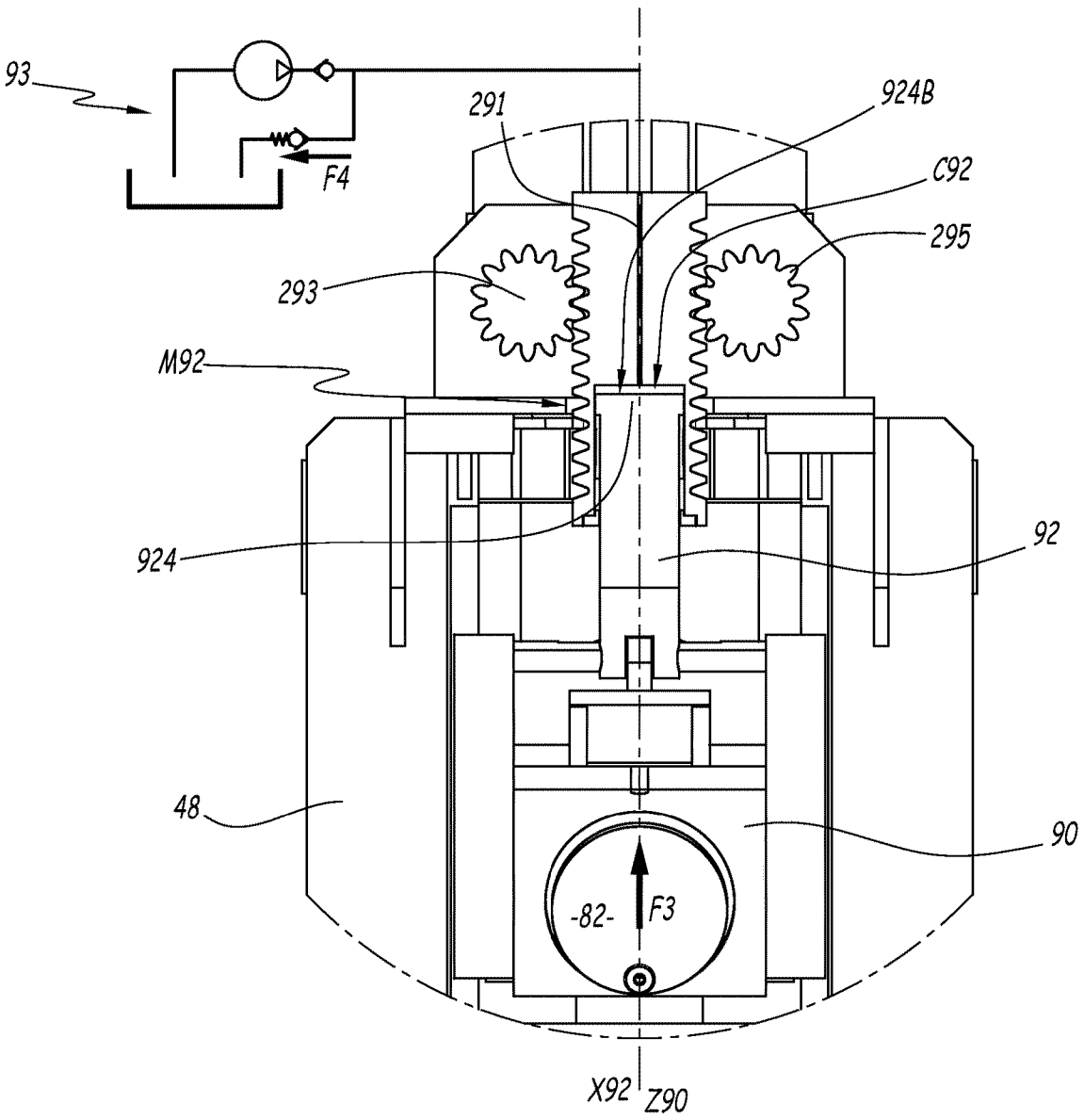
FIG. 10 is a view similar to FIG. 9 when the rolling mill is in a third operating configuration, in case of irregularity on a front surface of a part during shaping within the rolling mill.

The rack is guided in translation along the axis Z90 by rails formed in guide plates 197 and 199, the plate 199 being in partial tear-away in FIG. 8 and completely removed in FIGS. 9 and 10, for clarity of the drawings. The plates 197 and 199 are part of the auxiliary frame 48. The geared motors 192 and 194 are attached on the frame 48 through the plate 197.

The upper end of the bar 92 forms a piston 924 that is engaged, sealably owing to a gasket 924A, in a hollow housing 926 arranged in the lower part of the rack 292, at the center thereof. This constitutes a variable volume chamber C92 defined between the upper surface 924B of the piston 924 and the bottom 926B of the housing 926. A pipe 291 passes through the rack 292 over its entire height, from the housing 926, which makes it possible to connect the chamber C92 to a system 93 for supplying this chamber with pressurized oil. The system 93 comprises a pipe 932, a pump 934, a collection tub 936, a tared nonreturn valve 938 and a nonreturn valve 739.

In practice, the supply system 93 may or may not be identical to the supply system 73. These systems may be combined.

During normal operation of the rolling mill 2 shown in FIGS. 8 and 9, the pressure in the chamber C92 is sufficient for the kinematic chain KC between the rack 292 and the upper conical roller 82 to be rigid, which allows precise control of the height of said roller.

In case of irregularity protruding on the upper front surface P6 or on the lower front surface, the roller 82 is moved upward, in the direction of arrow F3 in FIG. 10, which is reflected by a vertical translation toward the top of the platen 90, the shoe 91 and the bar 92. This results in driving the oil present in the chamber C92 toward the system 93, therefore toward the tub 936 through the valve 938, as explained above regarding the bar 72 and the supply system 73, which is shown by arrow F4.

The operation here is comparable to that mentioned previously regarding the discharge mechanism M72. Therefore, formed in the axial cage 8 is a discharge mechanism M92 that allows precise control of the height of the conical roller 82 relative to the auxiliary frame 48, during normal operation of the rolling mill 2, and accommodation of any surface irregularity on one of the front surfaces P6 or P8, without risking damaging the geared motors 192 and 194, while the latter are mounted rigidly relative to the secondary frame 48.

Alternatively, the systems 73 and 93 can be replaced by other systems for supplying the variable volume chambers C72, C74, C92, etc. with pressurized oil at a given pressure. It is in particular possible to use an accumulator reservoir loaded with oil at the desired pressure and associated with a tared discharge valve, or an overloading chamber. In the case of an overloading chamber, the rod 273 is rigidly connected to the support 720 and the piston 724, which makes it possible to suction oil into the overloading chamber, like a syringe, before placing the variable volume chamber C72 or equivalent means under a pressure of about 250 bars while pushing back the piston 724, after having cut the communication between this chamber and the overloading chamber.

In the example described above, the invention is implemented to control the movement, in translation with respect to the frames 46 and 48, of the rollers 66 and 82. Alternatively, it can be used for only one of these rollers.

According to a variant of the invention that is not shown, the bars 72 and 74, on the one hand, and the bars 76 and 78, on the other hand, can be connected to one another by rear cross-pieces positioned opposite the cross-piece 68 and the plate 70. In this case, a pinion and rack assembly driven by one or several geared motors can be provided to control the movement of each rear cross-piece along the axis X2. The structure of the pinion and rack assembly mounted on the auxiliary frame 46 can be inspired by that shown in the figures for the axial cage 8, with equivalent of the bar 92 that is positioned horizontally and that attacks each rear cross-piece, in a separation direction relative to the axis Z62 of the main roller 62.

According to another variant, a single pinion and rack assembly is used to move both rear cross-pieces, and through them, the four columns. According to still another variant, a single cross-piece connects the four bars 72 to 78.

The number of traction bars used to control the translation of the roller 66 along the axis X2 may be different from four.

The embodiment and the variants considered above may be combined to generate new embodiments of the invention.

The invention claimed is:

1. A circular rolling mill comprising:

a fixed main frame;

an internal cylindrical roller intended to shape an internal radial face of an annular part and an external cylindrical roller intended to shape an external radial face of the annular part and rotated by a first driving electric motor, the internal cylindrical roller and the external cylindrical roller being supported by a first auxiliary frame mounted on the fixed main frame;

an upper conical roller intended to shape a front face of the annular part and a lower conical roller intended to shape an opposite front face of the annular part, the upper conical roller and the lower conical roller being each rotated by a second driving electric motor and supported by a second auxiliary frame mounted on, and movable with respect to, the fixed main frame;

at least a first rack and pinion assembly, including a first rack and a first pinion, to move the external cylindrical roller in translation relative to the first auxiliary frame;

at least a second rack and pinion assembly, including a second rack and a second pinion, to move one of the conical rollers relative to the second auxiliary frame;

a first supply system for supplying a first variable volume chamber with fluid under a pressure greater than or equal to 100 bars, this first supply system including a first pipe, a first pump that delivers oil at an input pressure, a first tub, a first tared non-return valve that connects the first pipe to the tub and a second non-return valve, mounted in the opposite direction from the first non-return valve, at the outlet of the first pump, to prevent the pressurized fluid from circulating through the first pump from its outlet toward its inlet; and a second supply system for supplying a second variable volume chamber with fluid under a pressure greater than or equal to 100 bars, this second supply system including a second pipe, a second pump that delivers oil at an input pressure, a second tub, a third tared non-return valve that connects the second pipe to the second tub and a fourth non-return valve, mounted in the opposite direction from the third non-return valve, at the outlet of the second pump, to prevent the pressurized fluid from circulating through the second pump from its outlet toward its inlet at least one electric geared motor, different from the first and second driving motors, to drive at least one of the first and second pinions of the first and second pinion and rack assemblies, wherein:

the electric geared motor is fixedly mounted relative to one of the auxiliary frames;

a first fluid discharge mechanism is interposed in a first kinematic chain for transmitting force between the first rack and the external cylindrical roller moved by first rack, for absorbing a temporary overload transmitted to the kinematic chain, in case of an irregularity of a face of the annular part shaped by the roller;

the first fluid discharge mechanism comprises the first variable volume chamber supplied with pressurized fluid by the first supply system and the volume of which varies as a function of the relative position of the external cylindrical roller and of the first rack;

the first fluid discharge mechanism is configured to absorb the temporary overload, without the first rack being moved, by discharging at least part of the pressurized fluid from the first variable volume chamber;

the first kinematic chain is configured so that, in case of irregularity protruding on the surface of an annular part shaped by the external cylindrical roller, the movement caused by this irregularity on a first transmission bar of the kinematic chain tends to drive the pressurized fluid from the first variable volume chamber into the first tub via the first tared non-return valve, by reducing the volume of the first variable volume chamber, a second fluid discharge mechanism is interposed in a second kinematic chain between the second rack of the second rack and pinion assembly and the conical roller and comprising the second variable volume chamber supplied with pressurized fluid by the second supply system and the volume of which varies as a function of the relative position of the conical roller and of the second rack, and the second kinematic chain is configured so that, in case of irregularity protruding on the surface of an annular part shaped by the conical roller, the movement caused by this irregularity on a second transmission bar of the second kinematic chain tends to drive the pressurized fluid from the second variable volume chamber into the second tub via the second tared non-return valve, by reducing the volume of the second variable volume chamber.

2. The rolling mill according to claim 1, wherein the first transmission bar is for transmitting a movement to the roller for moving the first rack along a longitudinal axis of the first transmission bar and wherein the first variable volume chamber is defined between on the one hand, the first transmission bar or a part secured to the first transmission bar; and on the other hand, the first rack or a part rigidly fastened to the first rack, or wherein the second transmission bar is for transmitting a movement to the roller for moving the second rack along a longitudinal axis of the second transmission bar and wherein the second variable volume chamber is defined between on the one hand, the second transmission bar or a part secured to the second transmission bar; and on the other hand, the second rack or a part rigidly fastened to the second rack.

3. The rolling mill according to claim 2, wherein the first variable volume chamber is defined inside the first transmission bar, or wherein the second variable volume chamber is defined inside the second transmission bar.

4. The rolling mill according to claim 2, wherein the first variable volume chamber is defined, along the longitudinal axis of the first transmission bar, between the first rack and the first transmission bar, or wherein the second variable volume chamber is defined, along the longitudinal axis of the second transmission bar, between the second rack and the second transmission bar.

5. The rolling mill according to claim 2, wherein part of the first transmission bar is received sealably in an internal cavity defined by the first rack and in that the first variable volume chamber is formed by the portion of this cavity not occupied by the first transmission bar, or wherein part of the second transmission bar is received sealably in an internal cavity defined by the second rack and in that the second variable volume chamber is formed by the portion of this cavity not occupied by the second transmission bar.

6. The rolling mill according to claim 5, wherein it comprises a system for supplying the first variable volume chamber with fluid under a pressure greater than or equal to 100 bars, and wherein the first variable volume chamber is connected to the first fluid supply system by a pipe that passes through the first rack, or wherein it comprises a system for supplying the second variable volume chamber with fluid under a pressure greater than or equal to 100 bars, and wherein the second variable volume chamber is connected to the second fluid supply system by a pipe that passes through the second rack.

7. The rolling mill according to claim 1, wherein the first fluid discharge mechanism comprises a piston secured to the first rack and a face of which defines the first variable volume chamber, or wherein the second fluid discharge mechanism comprises a piston secured to the second rack and a face of which defines the second variable volume chamber.

8. The rolling mill according to claim 7, wherein the first transmission bar is configured to transmit a movement to the roller for moving the first rack along a longitudinal axis of the first transmission bar, wherein the first variable volume chamber is defined between on the one hand, the first transmission bar or a part secured to the first transmission bar; and on the other hand, the first rack or a part rigidly fastened to the first rack and wherein the piston is mounted sliding inside the first transmission bar, along the longitudinal axis of the first transmission bar, or wherein the second transmission bar is configured to transmit a movement to the roller for moving the second rack along a longitudinal axis of the second transmission bar, wherein the second variable volume chamber is defined between on the one hand, the second transmission bar or a part secured to the second transmission bar; and on the other hand, the second rack or a part rigidly fastened to the second rack and wherein the piston is mounted sliding inside the second transmission bar, along the longitudinal axis of the second transmission bar.

9. The rolling mill according to claim 8, wherein the piston is secured to the first rack via a rack support and a connecting rod between the rack support and the piston, the rack support and the connecting rod also being mounted sliding inside the first transmission bar, along the longitudinal axis of the first transmission bar, or wherein the piston is secured to the second rack via a rack support and a connecting rod between the rack support and the piston, the rack support and the connecting rod also being mounted sliding inside the second transmission bar, along the longitudinal axis of the second transmission bar.

10. The rolling mill according to claim 9, wherein it comprises members for guiding in translation, along the longitudinal axis of the first transmission bar and inside the first transmission bar, the rack support or the connecting bar or both the rack support and the connecting bar, or wherein it comprises members for guiding in translation, along the longitudinal axis of the second transmission bar and inside the second transmission bar, the rack support or the connecting bar or both the rack support and the connecting bar.

11. The rolling mill according to claim 8, wherein the first variable volume chamber is defined between the face of the piston and a cover that closes off an internal volume of the first transmission bar, opposite the roller, or wherein the second variable volume chamber is defined between the face of the piston and a cover that closes off an internal volume of the second transmission bar, opposite the roller.

12. The rolling mill according to claim 10, wherein the members for guiding include guiding skids.

13. The rolling mill according to claim 1, wherein each roller translatable relative to one of the first and second auxiliary frames is moved by a pinion and rack assembly driven by an electric geared motor mounted fixedly relative to said one of the first and second auxiliary frames, with insertion of a fluid discharge mechanism in the kinematic force transmission chain between each rack and the roller driven by said rack.

14. The rolling mill according to claim 1, wherein the system for supplying at least one of the first variable volume chamber and the second variable volume chamber with fluid under pressure supplies fluid under a pressure greater than or equal to 200 bars.

15. The rolling mill according to claim 1, wherein the system for supplying at least one of the first variable volume chamber and the second variable volume chamber with fluid under pressure supplies fluid under a pressure of 250 bars.

16. The rolling mill according to claim 1, wherein at least one of the first fluid discharge mechanism and the second fluid discharge mechanism is configured to protect an electric motor and a reduction gear of the electric geared motor and protect the rack assembly against violent accelerations resulting from surface irregularities on the annular part during shaping in the rolling mill.

17. The rolling mill according to claim 1, wherein it includes a first electric geared motor, different from the first and second driving motors, to drive the pinion of the first pinion and rack assembly, said first electric geared motor being fixedly mounted relative to the first auxiliary frame;

a second electric geared motor, different from the first and second driving motors, to drive the pinion of the second pinion and rack assembly, said second electric geared motor being fixedly mounted relative to the second auxiliary frame.

18. A method for controlling the position of at least one roller for shaping a face of an annular part to be shaped within a circular rolling mill that comprises:

a fixed main frame;

an internal cylindrical roller intended to shape an internal radial face of the annular part and an external cylindrical roller intended to shape an external radial face of the annular part and rotated by a first driving electric motor, the internal cylindrical roller and the external cylindrical roller being supported by a first auxiliary frame mounted on the fixed main frame;

an upper conical roller intended to shape a front face of the annular part and a lower conical roller intended to shape an opposite front face of the annular part, the upper conical roller and the lower conical roller being each rotated by a second driving electric motor and supported by a second auxiliary frame mounted on, and movable with respect to, the fixed main frame;

at least a first rack and pinion assembly, including a first rack and a first pinion, to move the external cylindrical roller or one of the conical rollers relative to the fixed main frame;

at least a second rack and pinion assembly, including a second rack and a second pinion, to move one of the conical rollers relative to the second auxiliary frame;

a first supply system for supplying a first variable volume chamber, integrated into a first discharge mechanism interposed in a first kinematic force transmission chain between the first rack and the external cylindrical roller moved by the first rack, with fluid under a pressure greater than or equal to 100 bars, the first supply system including a first pipe, a first pump that delivers oil at an input pressure, a first tub, a first tared non-return valve that connects the first pipe to the first tub and a second non-return valve, mounted in the opposite direction from the first non-return valve, at the outlet of the first pump, to prevent the pressurized fluid from circulating through the first pump from its outlet toward its inlet;

a second supply system for supplying a second variable volume chamber, integrated into a second discharge mechanism disposed in a second kinematic force transmission chain between the second rack and the conical collar, with fluid under a pressure greater than or equal to 100 bars, the second supply system including a second pipe, a second pump that delivers oil at an input pressure, a second tub, a third tared non-return valve that connects the second pipe to the second tub and a fourth non-return valve, mounted in the opposite direction from the third non-return valve, at the outlet of the second pump, to prevent the pressurized fluid from circulating through the second pump from its outlet toward its inlet; and at least one electric geared motor, different from the first and second driving motors, to drive at least one of the first and second pinions of the first and second pinion and rack assemblies, wherein this method comprises the following steps:

a) supplying pressurized fluid to the first variable volume chamber, to stiffen the first kinematic chain during normal operation of the rolling mill in order to absorb a temporary overload transmitted to the first kinematic chain in case of irregularity of the surface shaped by the roller, and b) absorbing the temporary overload, without moving the first rack, by discharging at least part of the pressurized fluid from the first variable volume chamber into the first tub via the first tared non-return valve, by reducing the volume of the first variable volume chamber, in case of irregularity on the face of the annular part that is shaped by the roller.

* * * * *